US008382496B2

(12) United States Patent
Magari et al.

(10) Patent No.: US 8,382,496 B2
(45) Date of Patent: Feb. 26, 2013

(54) SECURITY DEVICE

(75) Inventors: Sean A Magari, Baldwinsville, NY (US); John A Taddeo, Liverpool, NY (US)

(73) Assignee: Eagle Comtronics, Inc., Liverpool, NY (US)

( * ) Notice: Subject to any disclaimer, the term of this patent is extended or adjusted under 35 U.S.C. 154(b) by 0 days.

(21) Appl. No.: 13/249,970

(22) Filed: Sep. 30, 2011

(65) Prior Publication Data

US 2012/0208382 A1 Aug. 16, 2012

Related U.S. Application Data

(60) Provisional application No. 61/441,966, filed on Feb. 11, 2011.

(51) Int. Cl.
*H01R 13/44* (2006.01)

(52) U.S. Cl. ..... 439/133

(58) Field of Classification Search ..... 439/133, 439/304, 307

See application file for complete search history.

(56) References Cited

U.S. PATENT DOCUMENTS

| | | | | |
|---|---|---|---|---|
| 3,519,979 | A * | 7/1970 | Bodenstein | 439/133 |
| 3,861,770 | A * | 1/1975 | Horak | 439/133 |
| 3,953,097 | A * | 4/1976 | Graham | 439/307 |
| 4,469,386 | A * | 9/1984 | Ackerman | 439/133 |
| 4,806,116 | A * | 2/1989 | Ackerman | 439/304 |
| 5,011,422 | A * | 4/1991 | Yeh | 439/307 |
| 5,435,736 | A * | 7/1995 | McMills et al. | 439/133 |
| 5,564,938 | A * | 10/1996 | Shenkal et al. | 439/301 |
| 5,723,818 | A * | 3/1998 | Yeh | 174/74 R |
| 6,234,818 | B1 * | 5/2001 | Chun Te | 439/304 |
| 6,848,920 | B2 * | 2/2005 | Fox | 439/133 |
| 7,144,271 | B1 * | 12/2006 | Burris et al. | 439/578 |
| 7,320,611 | B2 * | 1/2008 | Abbott | 439/133 |
| 7,452,239 | B2 * | 11/2008 | Montena | 439/133 |
| 2005/0208833 | A1 * | 9/2005 | Oksengorn | 439/620 |
| 2006/0089027 | A1 * | 4/2006 | Chawgo et al. | 439/133 |

* cited by examiner

*Primary Examiner* — Briggitte R Hammond
(74) *Attorney, Agent, or Firm* — Woods Oviatt Gilman LLP; Katherine M. McGuire, Esq.

(57) ABSTRACT

A security device for preventing or inhibiting unauthorized separation of a first part (e.g., a cable filter device) from a second part (e.g., a cable signal source) includes a connector having first and second connector parts which are freely rotatable with respect to each other, the first connector part including a male threaded end for removable connection to the first part and the second connector part including a female connector end for removable connection to the second part. A cylindrical sheath extends in covering relation to the first and second connector parts and is freely rotatable with respect thereto. In the attached condition, the first and second connector parts are accessible for attachment and removal only with a specially configured tool.

1 Claim, 7 Drawing Sheets

SECURITY DEVICE

BACKGROUND OF THE INVENTION

The present invention generally relates to tamper-proof security devices, and more particularly relates to a security device which may be attached to any two parts to inhibit unauthorized detachment of the parts from each other. In the embodiment shown and described herein, the security device is configured to attach to a cable connector or cable filter device to prevent or substantially inhibit the unauthorized removal thereof from the cable signal source.

Cable filter devices (also referred to as "cable traps") are well known and are used by cable companies to block the transmission of unauthorized communication transmission signals (e.g., television channels) from a cable signal source to the customer's television set. The cable filter device includes the channel blocking electronics, typically located on a printed circuit board, positioned within a cylindrical housing having F-connectors at either end to detachably connect to mating F-connectors at the signal source and the cable leading to the television set. F-connectors are threaded connectors which are standard sized coax cable connecting elements within at least the U.S. market. As such, cable filter devices are easily attached and removed from the mating F-connectors at the source and cable leading to the television set. Unauthorized, illegal removal of the cable filter device has unfortunately been a common problem resulting in loss of revenue by the cable provider.

SUMMARY OF THE INVENTION

The present invention addresses the problem of unauthorized removal of cable connectors or cable filter devices by providing a security device which prevents or at least substantially inhibits the unauthorized removal of the cable connector or cable filter device from the cable signal source and cable leading to the television set.

The security device generally comprises first and second connectors, the first connector part having opposite threaded male and female ends and the second connector part having a smooth shank and a threaded female head portion. The smooth shank is inserted into the central bore of the first connector part and the parts are secured together via a radially extending flange at the terminal end of the smooth shank which engages with the shank of the first connector part. As such, the first and second connector parts are secured together while allowing one to rotate freely with respect to the other without axial translation of one part relative to the other. A cylindrical sheath is positioned in covering relation to the first and second connector parts and may freely rotate thereon, again, with no axial translation of the sheath relative to the first and second connector parts. Specially configured tools are provided to allow authorized personnel to alternately attach and remove the security device from the parts to which it is connected (e.g., the connector and cable filter device). Without the specially configured tools, any attempt to remove the cable filter device is futile due to the freely rotating sheath covering the security connector parts. It is noted that installation of the security device to a first part (e.g. filter) can be done in the field with one of the specially configured tools but may alternately be done at the manufacturer whereby the security device is shipped already attached to a first part (e.g., connector or filter).

DETAILED DESCRIPTION OF A PREFERRED EMBODIMENTS

Figure 8:
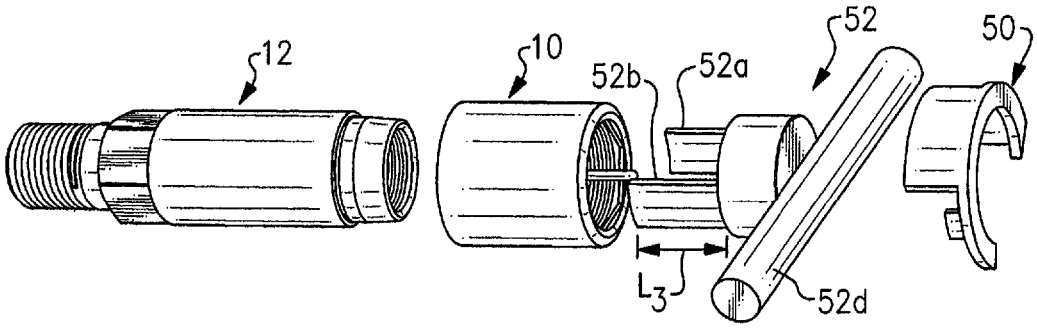
FIG. 8 is a perspective view similar to FIG. 6 except showing the security device in spaced relation to the filter and further showing another embodiment of tool which may be used to attach the security device to the filter.
Figure 9:
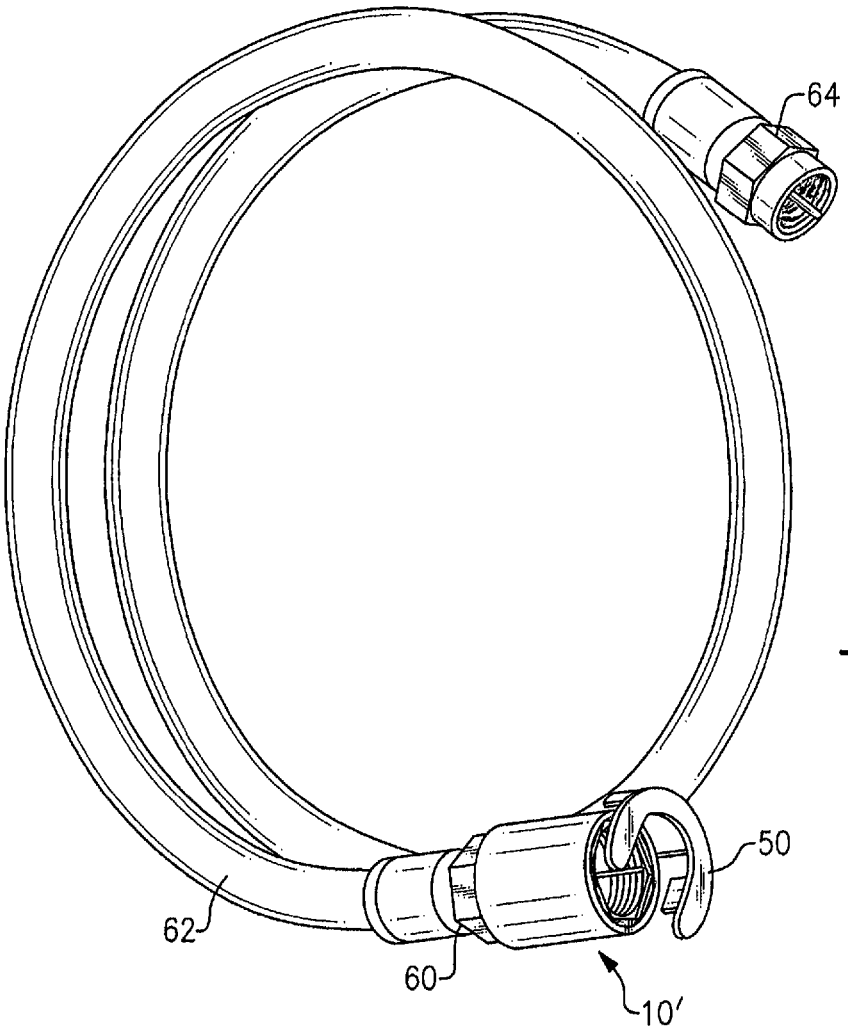
FIG. 9 is a perspective view of another embodiment of the security device attached to the connector end of an R59 CATV cable.

Referring to the drawing, there is seen in the Figures a security device generally indicated by reference numeral 10 adapted for mounting between a first part and a second part to inhibit unauthorized removal or detachment of the first part from the second part. The first and second parts can be any types of parts where it is desired to prevent or inhibit the removal of the parts from each other. The first part may take the form of a device such as the cable filter device indicated generally by the reference numeral 12 in FIGS. 1-3 and 8, or an R59 CATV cable and connector as seen in FIG. 9.

Referring first to attachment of the security device to the cable filter example, cable filter device 12 is known (also referred to as a "trap") and operates to prevent transmission of unauthorized channels or other communication information from signal source 14 (e.g., cable junction box receiving transmission from cable company) and signal source connector 14*a* through to the cable 16 which connects to the signal output device 18 (e.g., television set). In particular, cable filter device 12 includes an electronic device such as a chip or a printed circuit board (PCB) 20 which may be programmed by the cable company to prevent transmission of unauthorized signals therethrough. Electric leads 22 and 24 extend from opposite ends of PCB 20 to carry the signals through the PCB from source 14 to device 18, respectively. Absent cable filter device 12, cable 16 would connect directly to source 14 via female F-connector 16*a* and male F-connector 14*a*.

As discussed previously, cable filter devices which do not have a security device allow the unscrupulous person to easily remove the filter and illegally receive unauthorized signals. Although such security devices have been proposed before, the present invention provides a security device which is very effective at inhibiting unauthorized removal of the cable filter device 12 (or other device or part which is only meant to be removed from a second part by authorized personnel). As will be discussed in detail below, a special tool is required to remove filter device 12 from the part to which it is connected, thus inhibiting anyone not having the special tool from removing cable filter device 12.

Figure 1:
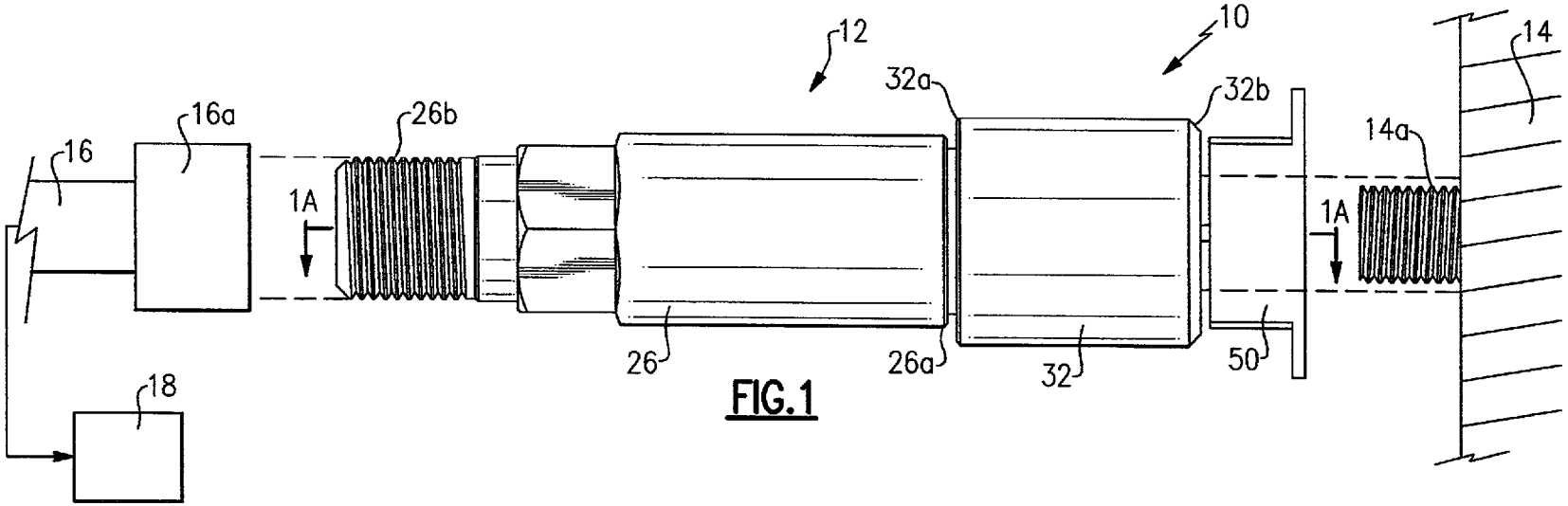
FIG. 1 is a side elevational view of an embodiment of the inventive security device attached to a prior art cable filter device (approximately 2:1 scale) in spaced relation to a signal source and output device shown in schematic.
Figure 3:
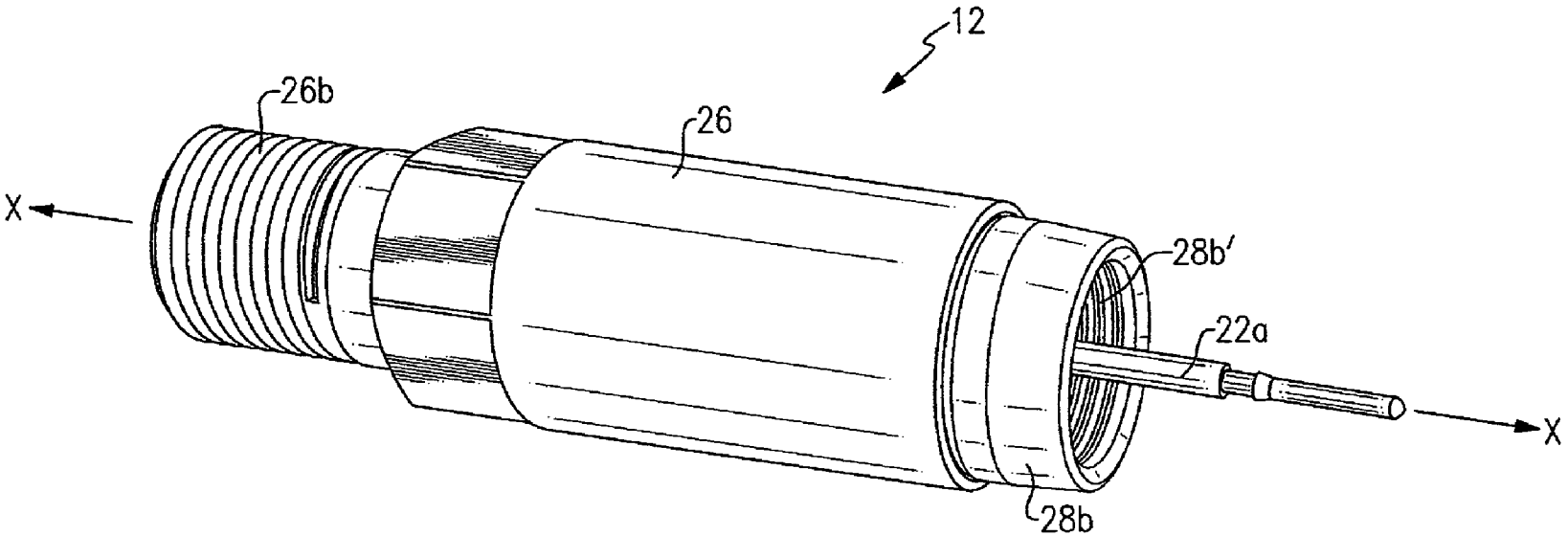
FIG. 3 is the view of FIG. 2 with the F-connector attached to the cable filter device housing and the electric lead extending therefrom.

A common type of coax cable connectors are known in the industry as "F-connectors". An F-connector 28 (FIGS. 1A, 2 and 3) having a male end 28*a* and opposite female end 28*b* having internal threads 28*b*' is provided with male end 28*a* fixed to a first end 26*a* of the cylindrical housing 26 of cable filter device 12. The opposite second end 26*b* of housing 26 is in the form of a male threaded shank for removable attachment to coax cable female F-connector 16*a* (FIG. 1). Housing 26 includes an axial bore 26' extending entirely therethrough from first end 26*a* to second end 26*b* thereof. As seen best in FIG. 2, F-connector 28 is rotationally fixed to housing 26 via longitudinally extending splines 28*c* which mate with cooperatively formed splines 26*c* located on the inner wall 26*d* of housing 26. Housing 26 and connector 28 are also axially secured together by a rolling operation performed on housing end 26*a* which deforms and presses ("crimps") the terminal edge thereof radially inward onto the annular shoulder 28*d* of connector 28. As seen in FIG. 3, in the fully attached condition, F-connector female end 28*b* protrudes from housing 26. A conductor extension 22*a* is collinearly attached to electric lead 22 and is of a length sufficient to extend through security device 10 and make connection with signal source 14 in the fully attached condition as will be described further below. An axial locator element 23 and plug 25 may be provided at housing end 26*b* through which opposite lead 24 extends to maintain axial positioning thereof with respect to housing 26.

Figure 1A:
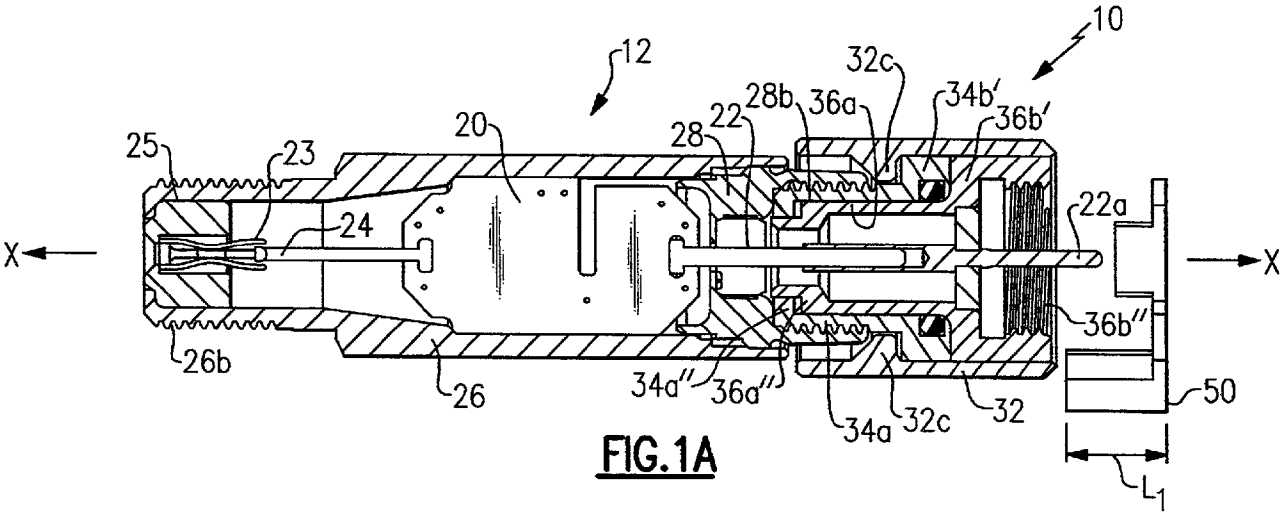
FIG. 1A is a cross-sectional view of the cable filter and security device as taken generally along the line 1A-1A in FIG. 1.
Figure 2:
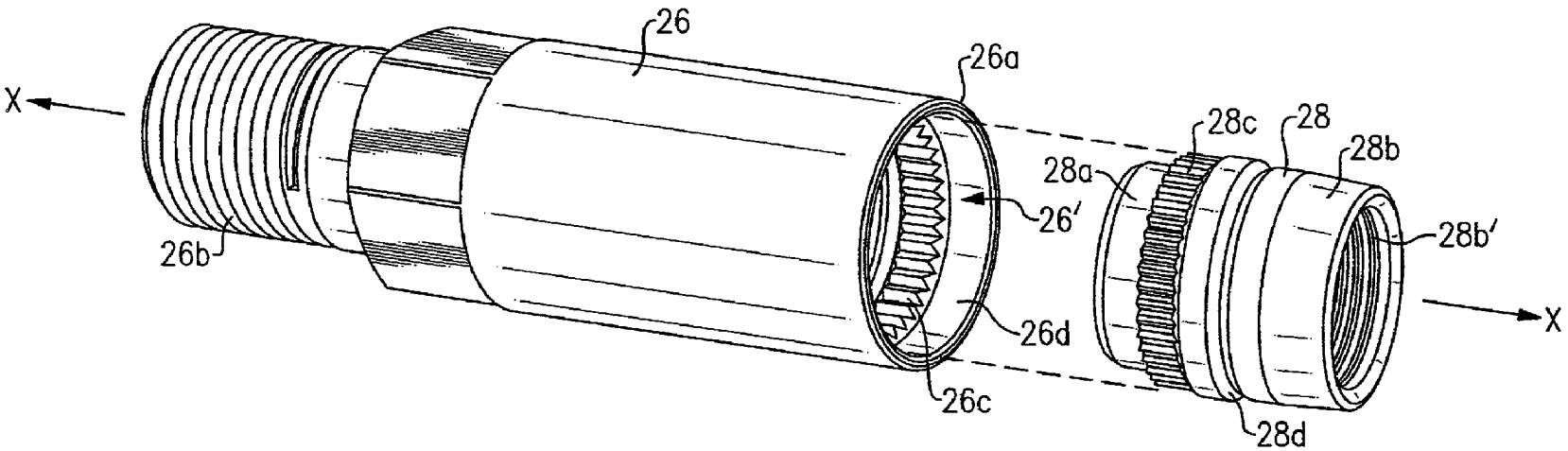
FIG. 2 is an enlarged perspective view of the cable filter device housing and F-connector in spaced relation thereto.
Figure 4:
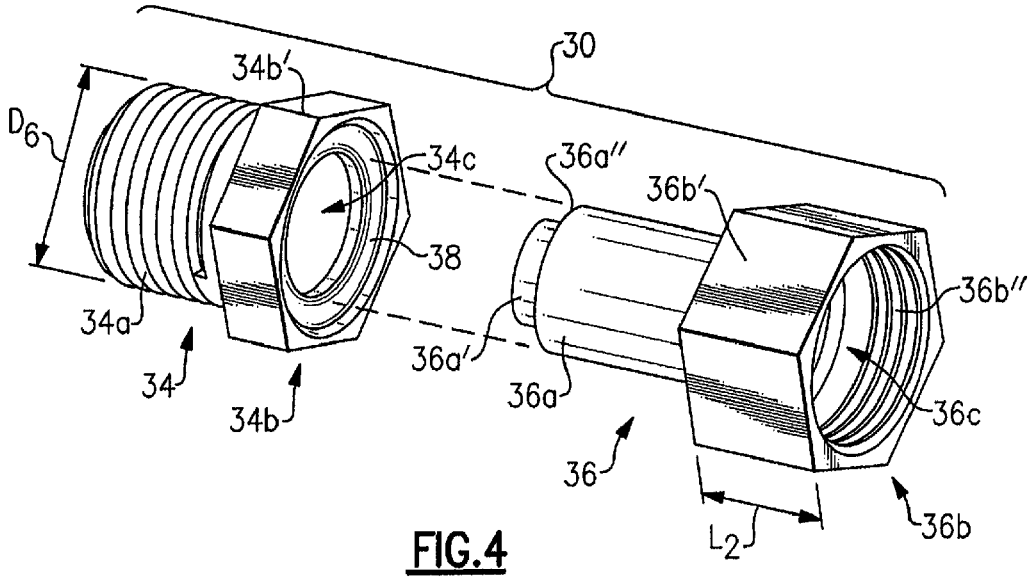
FIG. 4 is an enlarged perspective view of an embodiment of the security device first and second connector parts in spaced relation to each other.
Figure 5:
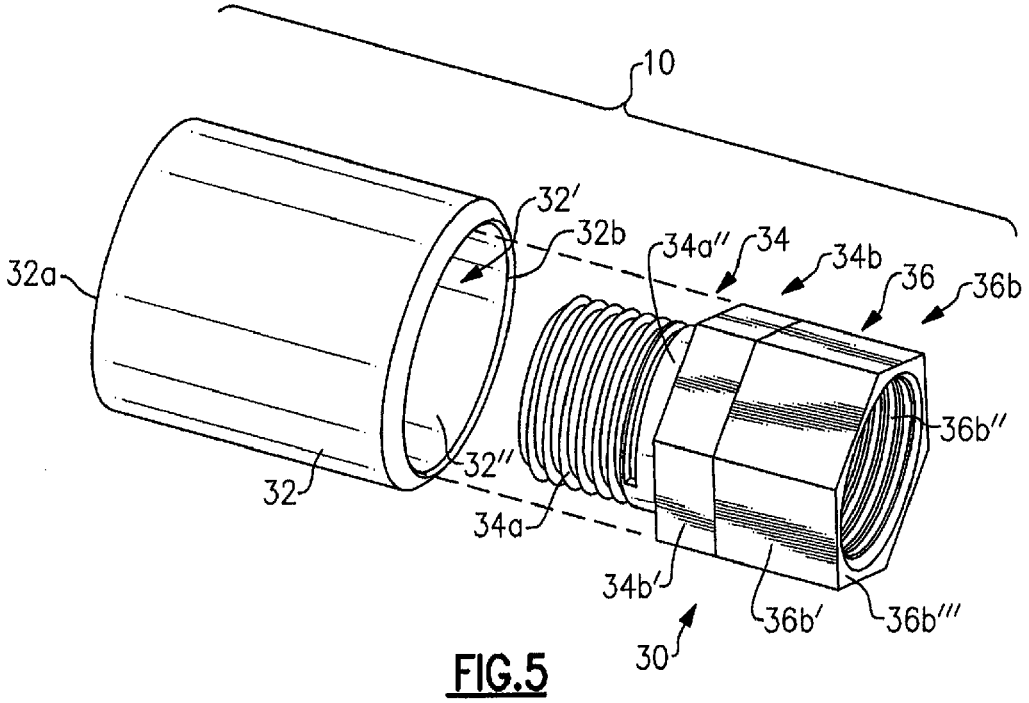
FIG. 5 is the view of FIG. 4 showing the first and second connector parts in the assembled condition with the cylindrical sheath of the security device shown in spaced relation thereto.
Figure 6:
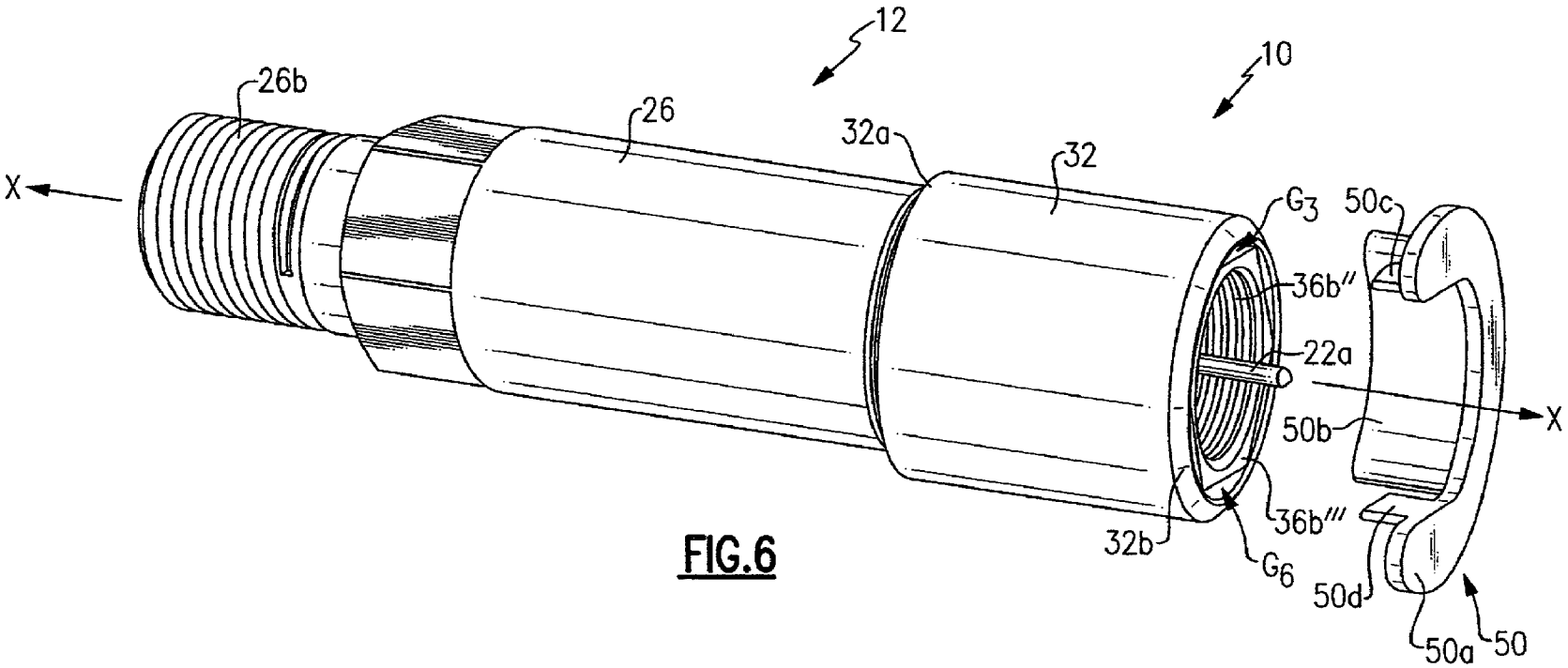
FIG. 6 is the view of FIG. 3 showing the security device attached to the cable filter device and the security attachment/removal tool shown in spaced relation thereto.

Referring now to security device 10, as seen best in FIGS. 4 and 5, security device 10 includes a connector 30 and cylindrical sheath 32 which extends in covering relation to connector 30 in the fully assembled condition with filter device 12 as seen in FIGS. 1, 1A and 6. Connector 30 is itself comprised of first and second connector parts 34 and 36, respectively. First connector part 34 includes a first male end in the form of a threaded shank 34*a* and a second female end 34*b* having a head portion 34*b*' which is preferably non-circular to allow engagement with a tool and is preferably in the form of a hexagon. An axial bore 34*c* extends the entire length of first connector part 34. Second connector part 36 includes a first male end 36*a* in the form of a non-threaded, smooth surface shank 36*a* having a smaller diameter free end portion 36*a*' forming a shoulder 36*a*" with larger diameter portion 36*a* to assist in axially locating first and second connector parts 34 and 36 together in the manner described below. Second connector part 36 further includes a second female end 36*b* having a head portion 36*b*' which is preferably non-circular to allow engagement with a tool and is preferably in the form of a hexagon and includes internal threads 36*b*". An axial bore 36*c* extends the entire axial length of second connector part 36.

First and second connector parts 34 and 36 are secured together in coaxial alignment with shank 36*a* of second connector part 36 located within bore 34*c* of first connector part 34 and second component head portion 36*b* in abutting contact with first component head portion 34*b*. As seen in FIG. 1A, first component first end 34*a* includes a radially inwardly directed flange 34*a*" defining a narrowed opening through which smaller diameter shank end portion 36*a*' extends and against which shoulder 36*a*" abuts. An O-ring 38 is located at the interface of first component head portion 34*b* and second component head portion 36*b*. Since the interface between the shanks and head portions of the first and second components is smooth, the components may rotate freely with respect to each other.

Sheath 32 includes a central bore 32' extending entirely therethrough from first end 32*a* to second end 32*b*. Connector 30 (comprising assembled connector components 34 and 36) is inserted into sheath bore 32' at second end 32*b* thereof as seen in FIG. 5. In the fully assembled condition of the security device 10, cylindrical sheath 32 lies in covering relation to connector 30 with second sheath end 32*b* lying substantially flush with second component head surface 36*b*'". The diameter $D_1$ of sheath bore 32' is only slightly larger than the maximum diameter $D_2$ of first and second component head portions 34 and 36 such that these surfaces lie in closely adjacent yet freely rotatable relationship to each other as seen in FIGS. 1, 1A, 6 and 7. The "points" of the hexagonal head portion 36*b* define the maximum diameter $D_2$ with the intermediate flat surfaces thereof defining the minimum diameter $D_3$. With $D_3$ smaller than $D_1$, longitudinally extending gaps $G_1$-$G_6$ are formed between component head portions 34, 36 and sheath 32 in annularly spaced fashion about and between the head components 34*b*, 36*b* and the sheath inner bore surface 32" (FIG. 7). Gaps $G_1$-$G_6$ allow entry and exit of specially configured tools 50 seen in FIGS. 1, 1A and 6 and tool 52 seen in FIG. 8, both of which will be described more fully below.

Figure 7A:
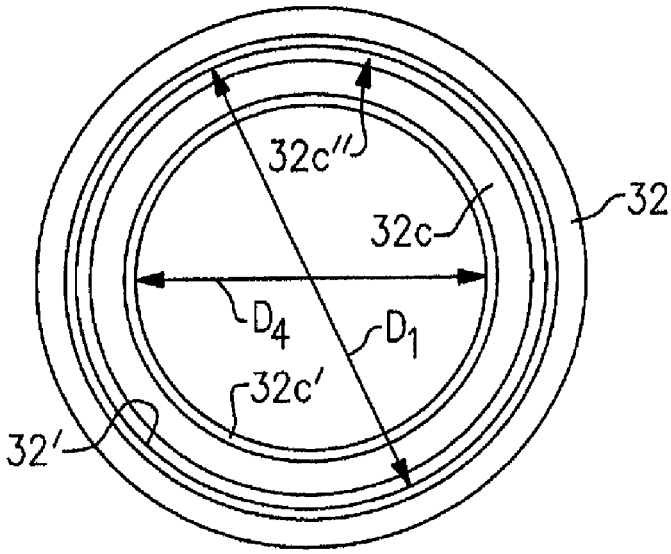
FIG. 7A is an end view of the sheath.

As seen in FIGS. 1A and 7A, a radially inwardly extending annular flange 32*c* is located on sheath inner wall 32" approximately ⅓ down the length of sheath 32 from first end 32*a* to second end 32*b* and has an inner edge flange diameter $D_4$. Upon fully inserting connector 30 into sheath 32, first connector head portion 34*b* abuts flange 32*c*.

In one embodiment of security device 10, the maximum diameter $D_6$ of threaded shank 34*a* (FIG. 4) is slightly less than the inner edge diameter $D_4$ of flange 32*c*. As such, component 30 freely inserts into sheath 32 without any rotation of the component relative to the sheath 32 required. As such, in this embodiment, component 30 and sheath 32 are loosely held together until they are attached to cable security device 12 or other part.

In a second, more preferred embodiment of security device 10, inner flange edge 32*c*" is threaded and of a diameter such that as component 30 is passed into sheath bore 32', threaded shank 34*a* engages and must be rotated relative to sheath 32 to extend past flange 32*c*. In this embodiment, the threads adjacent head portion 34*b*' are relieved to provide a smooth surface relief area as indicated at 34*a*" in FIG. 5. Once flange 32*c* reaches and is located within relief area 34*a*", component 30 and sheath 32 may rotate freely with respect to each other without axial translation of one with respect to the other. When handling security device alone (without attachment to any other part as of yet), sheath 32 may be removed from component 30 only by holding component 30 fixed and rotating sheath 32 in the opposite direction which again engages threaded shank 34*a* through flange 32*c* to withdraw component 30 in the opposite direction to which it was inserted into sheath 32. This embodiment therefore allows preassembly of component 30 to sheath 32 allowing easy shipping and handling during installation onto cable security device 12 (or other part).

Figure 7B:
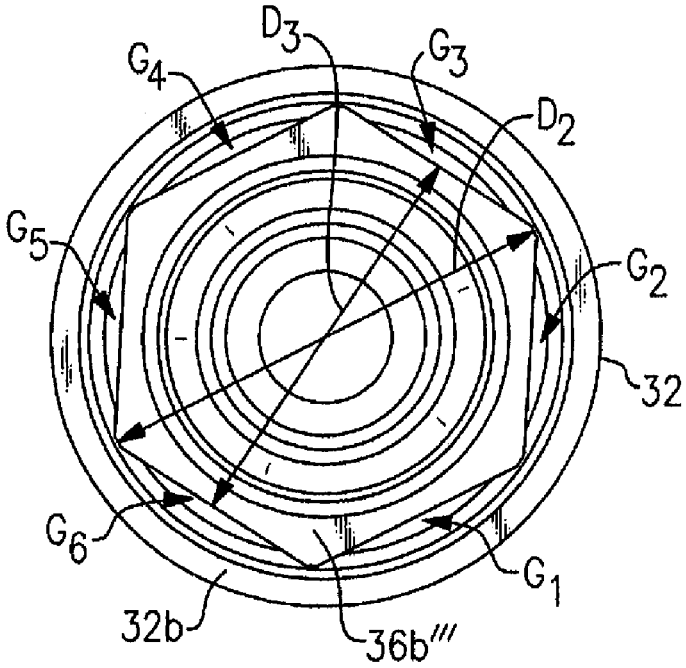
FIG. 7B is the view of FIG. 7A including the first and second connector parts located within the sheath.

With component 30 and sheath 32 assembled together in the manner described above, security device 10 may now be attached between first and second parts having attachment components which will mate with the attachment portions of security device 10. More particularly, as seen in the embodiment of FIG. 1A, security device 10 is attached to cable security device 12 by threading threaded shank 34*a* into F-connector female end 28*b*. As mentioned above, this assembly may be done either at the manufacturer or in the field. As seen in FIG. 8, a specially configured tool 52 may be used to tighten security device 10 to filter device 12. In particular, tool 52 includes at least one but preferably two prongs 52*a* and 52*b* extending from a head portion 52*c* and T-style handle 52*d* used to manually grip tool 52. Each prong 52*a* and 52*b* is of a length $L_3$ which is longer than the length $L_2$ of second component head portion 36*b*' (FIG. 4) so that when prongs 52*a* and 52*b* are inserted into any pair of diametrically opposed gaps $G_1$-$G_4$, $G_2$-$G_5$, or $G_3$, $G_6$ located between components 34, 36 and sheath 32 (FIG. 7B), the prongs reach first component head portion 34*b*'. As such, both component heads portions 34*b*' and 36*b*' are engaged and may be rotated together to thread and tighten threaded shank 34*a* into female threaded end 28*b* following which tool 52 may be withdrawn from the selected pair of diametrically opposed gaps $G_1$-$G_6$.

Security device 10 together with cable filter device 12 is then attached to second part 14 (e.g., the communication data source) by threading female end 36*b* onto male connector 14*a*. A different specially configured tool 50 is provided which is required to alternately secure and remove security device 10 to and from another part at female end 36*b*. More particularly, tool 50 includes a C-shaped segment 50*a* from which extends a main arcuate wall segment 50*a* with at least one but preferably two prongs 50*c* and 50*d* extending perpendicularly from C-shaped segment 50*a*. As described above, first and second components 34, 36 may rotate freely with respect to each in the assembled condition seen in FIG. 5. With sheath 32 covering components 34, 36, in order to secure connector female end 36*b* onto male end 14*a*, tool 50 is used by inserting prongs 50*c*, 50*d* into any pair of diametrically opposed gaps $G_1$-$G_4$, $G_2$-$G_5$, or $G_3$, $G_6$ located between components 34, 36 and sheath 32 (FIG. 7B). The length $L_1$ of tool segments 50*c*, 50*d* (FIG. 1A) is not longer than the length $L_2$ of second component head portion 36*b* (see FIG. 4) such that prongs 50*c*, 50*d* extend to reach and engage only first component head portion 34*b*'. As such, prongs 50*c*, 50*d* may only rotate component 36 which will rotate independently with respect to component 34. It is noted main arcuate wall segment 50*a* is of a radius only slightly larger than the radius of sheath 32 such that main arcuate wall segment 50*a* will engage the exterior surface of sheath 32 and thereby assist with stabilizing tool 50 on security device 10 and also assist with the proper alignment of tool prongs 50*b* and 50*c* as they are inserted into the selected pair of diametrically opposed gaps $G_1$-$G_4$, $G_2$-$G_5$, or $G_3$, $G_6$ In the engaged position, the user manually grasps and turns C-shaped segment 50*a* which causes the rotation of second component 36 onto end 14*a*. It will be appreciated that sufficient clearance must exist between sheath end 32*b* and first part 14 structure (e.g. housing) or other structure surrounding the attachment point at end 14*a* to allow tool 50 to be inserted between sheath end 32*b* and the surrounding structure. The clearance provided should not be much larger than to allow the relatively short tool 50 to engage security device 10 as described above. Limiting this clearance reduces the chance of an unauthorized person inserting another type of tool (e.g., a screwdriver) into gaps $G_1$-$G_6$ which is required to reach and rotate first component head 34 as discussed above.

Since sheath 32 covers and freely rotates about component parts 34 and 36 as described above, they are not accessible without specially configured tool 50. There is thus no surface accessible to fix components 34 and 36 in place while attempting to rotate and remove cable filter device 12 therefrom. Thus, any rotation of housing 26 will simply result in the free rotation of first component part 34 while second component part 36 remains rotationally fixed. As such, no axial translation between or detachment of the parts will occur. Furthermore, any attempt to insert a tool into sheath end 32*a* will be futile as it will not reach second component part 34 due to the presence of female end 28*b* and flange 32*c* (FIG. 1A).

With cable filter device 12 attached to security device 10 and first part 14, cable output device 18 may be attached to end 26*b* by threading female F-connector 16*a* of cable 16 onto male F-connector end 26*b* of cable filter device 12 (FIG. 1) to thereby establish the signal connection between source 14 and output device 18.

FIG. 9 shows an embodiment of security device 10' which is secured directly to the connector 60 on an R59 cable having a connector 64 at the opposite end of the cable 62.

As discussed above, security device 10 may be used to couple any two parts together which already have or are adapted to connect to connectors configured to mate with the opposite ends of the security device. It is therefore understood that the present invention is therefore not limited to the particular device attachment embodiments shown and described herein.

What is claimed is:

1. A security device for inhibiting unauthorized removal of a first part from a second part, said security device comprising:

a) a connector having first and second connector parts freely rotatably connected to each other, said first connector part having a threaded male end for removable attachment to a first part, said second connector part having a female threaded end located opposite said first connector part male end adapted for removable attachment to a second part; and b) a cylindrical sheath having an inner wall defining a central bore, said inner wall including a flange positioned adjacent a smooth annular area located on said first connector part male end, said flange and said smooth annular area forming a freely rotatable connection between sheath and said connector, said sheath extending about said first and second connector parts in covering relation thereto.

* * * * *